US005680778A

United States Patent [19]

Seo

[11] Patent Number: 5,680,778

[45] Date of Patent: Oct. 28, 1997

[54] ROTARY MOUNTING FOR SHAFT SECTIONS OF A CLOTHES WASHER POWER TRANSMISSION

[75] Inventor: Je Man Seo, Suwon, Rep. of Korea

[73] Assignee: Samsung Electronics Co., Ltd., Suwon, Rep. of Korea

[21] Appl. No.: 708,201

[22] Filed: Sep. 6, 1996

[30] Foreign Application Priority Data

Sep. 22, 1995 [KR] Rep. of Korea ..... 95-31327

[51] Int. Cl.[6] ..... D06F 37/40

[52] U.S. Cl. ..... 68/23.7

[58] Field of Search ..... 68/23.6, 23.7

[56] References Cited

FOREIGN PATENT DOCUMENTS 15097 1/1989 Japan ..... 68/23.7

178293 7/1989 Japan ..... 68/23.7

*Primary Examiner*—Philip R. Coe

*Attorney, Agent, or Firm*—Burns, Doane, Swecker & Mathis, L.L.P.

[57] ABSTRACT

A clothes washer includes a washing basket in which an oscillatory agitator is disposed. A power transmission interconnects a motor with the basket and agitator. The power transmission includes a washing shaft assembly connected to the agitator and a hollow dehydrating shaft assembly connected to the basket. The washing shaft assembly passes through the hollow dehydrating shaft assembly. The dehydrating shaft assembly includes a first dehydrating shaft connected to the basket, and a second shaft having an inner circumference which is press-fit to an outer circumference of the first dehydrating shaft. The outer periphery of the second dehydrating shaft is rotatably supported within a bearing.

2 Claims, 4 Drawing Sheets

ROTARY MOUNTING FOR SHAFT SECTIONS OF A CLOTHES WASHER POWER TRANSMISSION

BACKGROUND OF THE INVENTION

The present invention concerns a power transmission mechanism for a clothes washer.

A washer having a conventional power transmission mechanism is illustrated in FIG. 2. The washer comprises a water container 11 enclosed in a housing 10 for containing water, a washing basket 12 rotatably mounted in the water container 11, and an oscillating agitator blade or agitator 13 with a plurality of blades mounted on the bottom of the washing basket 12. Beneath the water container 11, there is a motor 15 for rotating the washing basket 13 and the rotating blade 13. Further, a power transfer device 20 is mounted beneath the water container 11. The power transfer device 20 receives the rotation power of the motor 15 through a belt 16. The reduced suitable speed for washing or spinning mode is selectively transferred to only the rotating blade 13 or both the rotating blade 13 and the washing basket 12. FIG. 3 shows a conventional power transmission mechanism. In a cup 28 mounted under the water container 11, a hollow dehydrating or spin drying shaft assembly 22 is provided, one end of which is fixed to the washing basket 12 and the other end of which is projected near the upper surface of a pulley 23. Further, through the hollow shaft assembly 22 is provided a washing shaft assembly 21 the ends of which are fixed to the rotating blade 13 and the pulley 23, respectively.

The washing shaft assembly 21 comprises a first shaft 21A whose upper end is connected to the rotating blade and a second shaft 21B whose lower end is connected to the pulley 23. Moveover, between the first and the second shafts 21A,21B, there is provided a planetary gear 26 for coupling the shafts 21A,21B together and for reducing the rotation speed received through the pulley 23 down to a predetermined speed.

The hollow dehydrating shaft assembly 22 comprises a first shaft 22A or connector whose upper end is connected to the washing basket 12, a third shaft 22C or gear case whose lower end is detachably connected to a second shaft 21B the second shaft 22B serves as a case drum for the planetary gear 26 and is press-fitted to the lower end of the first shaft 22A and to the upper end of the third shaft 22C.

Between the first shaft 22A and the cup 28 is fittedly mounted an upper bearing 27U for supporting the rotation of the first shaft 22A. Between the middle portion of the third shaft 22C and the middle portion of the second shaft 21B is fittedly mounted a lower bearing 27L for supporting the rotation of the third shaft 22C.

At a lower portion of the first shaft 21B and the third shaft 22C is provided a clutch 24 which transmits the power of the pulley 23 to both the washing shaft assembly 21 and the dehydrating shaft assembly 22, or to only the dehydrating shaft 22 assembly.

Further, a one way direction clutch bearing 30 is provided on the outside of the middle portion of the third shaft 22C. The bearing prevents the washing basket 12 from being rotated when in the washing mode.

The operation of the conventional power transmission mechanism is as follows:

In the beginning stage of the washing mode, since the clutch 24 is disengaged, only the second shaft 21B connected to the pulley 23 is rotated. That is, the one way clutch bearing 30 prevents the third shaft 22C from rotating. Moreover, the dehydrating shaft assembly 22 would not rotate owing to the activation of a band brake 29 which is mounted in the second shaft 22B and thus the washing basket 12 is in a fixed condition. The rotation force of the second shaft 21B is reduced in a speed by the planetary gear 26. The reduced speed force is transmitted to the first shaft 21A. The rotating blade 13 integrally mounted on the upper end of the first shaft 21A is rotated for performing the washing mode. In the dehydrating mode, the clutch 24 is engaged by a clutch lever 25C, thereby connecting the washing shaft 21 assembly to the dehydrating shaft assembly 22. The rotation force given to the pulley 23 is simultaneously transmitted to both the rotating blade 13 and the washing basket 12. The laundry is dehydrated by the high speed rotation of the rotating blade 13 and the washing basket 12.

However, in the aforementioned power transmission mechanism, the second shaft 22B is coaxially fitted on the outer circumference of the first shaft 22A and next the upper bearing 27U which is already mounted in the cup 28 is coaxially placed on the outer circumference of the first shaft 22A. Since the outer circumference of the first shaft 22A, on which the second shaft 22B and the upper bearing 27U is fittedly mounted, are over-extended in height, there is a problem in keeping the first shaft 22A on a desire axis. Also, there is another problem that the upper bearing 27U and the second shaft 22B are fitted on the first shaft 22A with poor concentricity. Therefore, in this power transmission mechanism which can rotate both the dehydrating shaft and the washing shaft in a high speed mode, if the center axis of the second shaft which is press-fitted in the outer circumference of the first shaft is not coincident with the center axis of the upper bearing which is press-fitted on the outer circumference of the first shaft there results vibration and noise.

SUMMARY OF TEE INVENTION

It is the purpose of the present invention to provide a power transmission mechanism which lessens the press-fit area so as to easily achieve concentricity, thereby decreasing vibration and noise with the purpose of achieving reliability and lower cost.

According to the present invention, a power transmission mechanism for a washer comprises a washing basket having a plurality of openings; an agitator rotatively mounted in the washing basket; a washing shaft extending to the agitator through the washing basket; a dehydrating shaft housing the washing shaft and fixedly connected to the washing basket with an end thereof, and press-fitted in the inner circumference of a gear housing with another end thereof, the gear housing having a gear which is connected to the washing shaft; a bearing press-fitted to the outer circumference of the gear housing; and a clutch selectively transmitting the driving force of the motor either to the dehydrating shaft through the gear housing or to the washing basket through the gear.

BRIEF DESCRIPTION OF THE DRAWINGS

The present invention will now be described in detail with reference to the accompanying drawings, in which.

DESCRIPTION OF PREFERRED EMBODIMENTS

Figure 1:
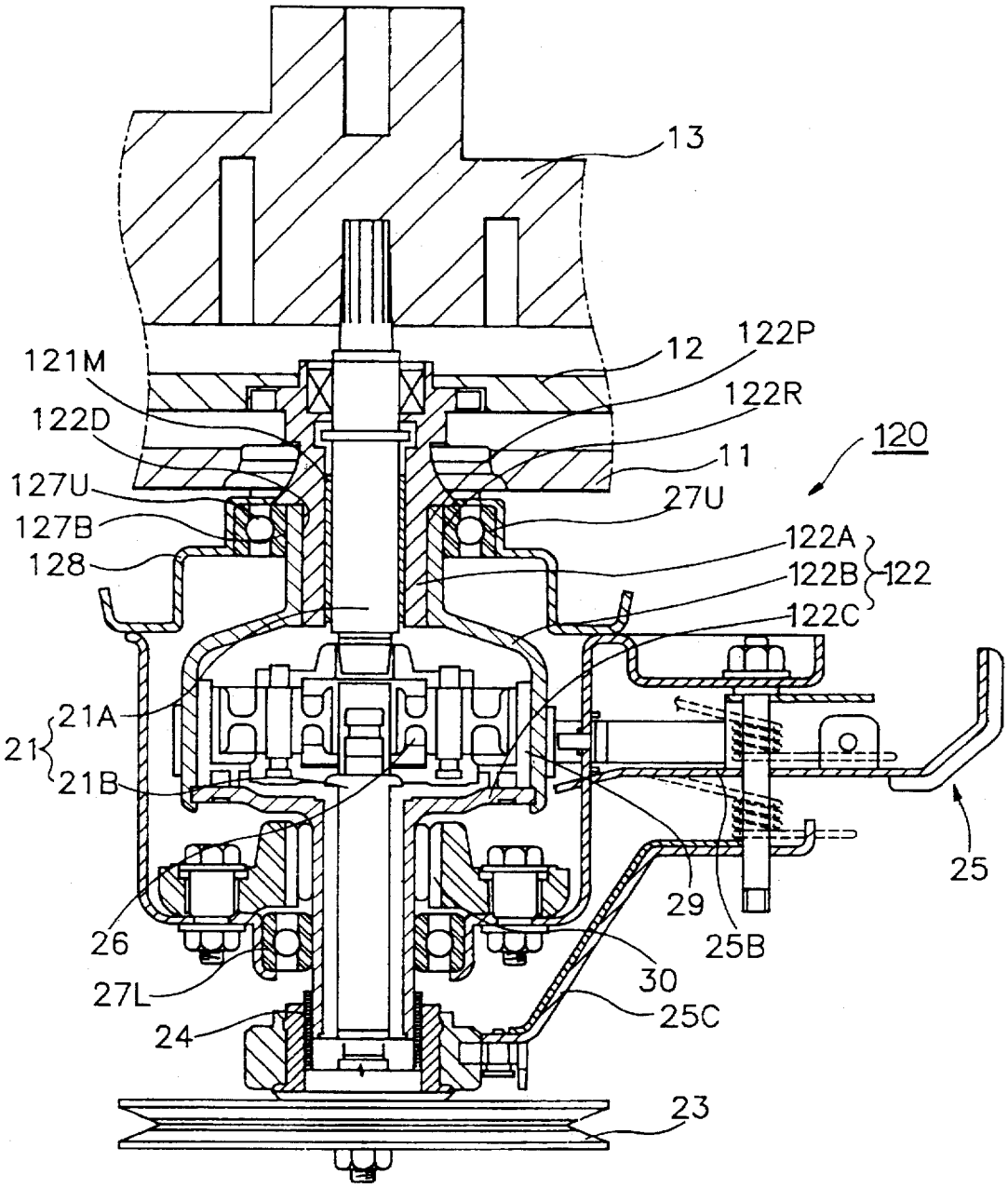
FIG. 1 is a vertical sectional view for illustrating a power transmission mechanism for a washer according to the a first embodiment of present invention.
Figure 2:
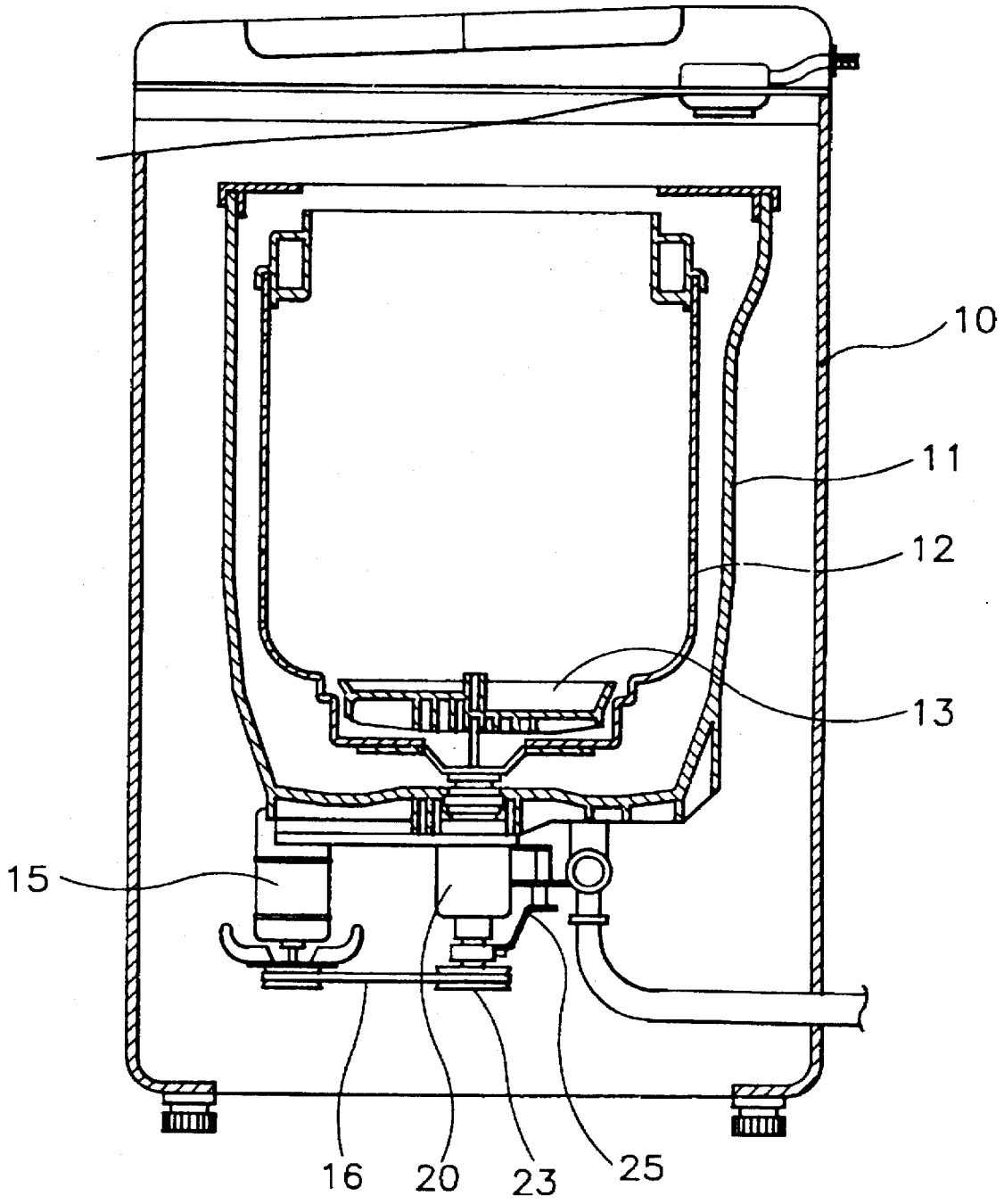
FIG. 2 (PRIOR ART)
FIG. 2 is a vertical sectional view of washer having a conventional power transmission mechanism.
Figure 3:
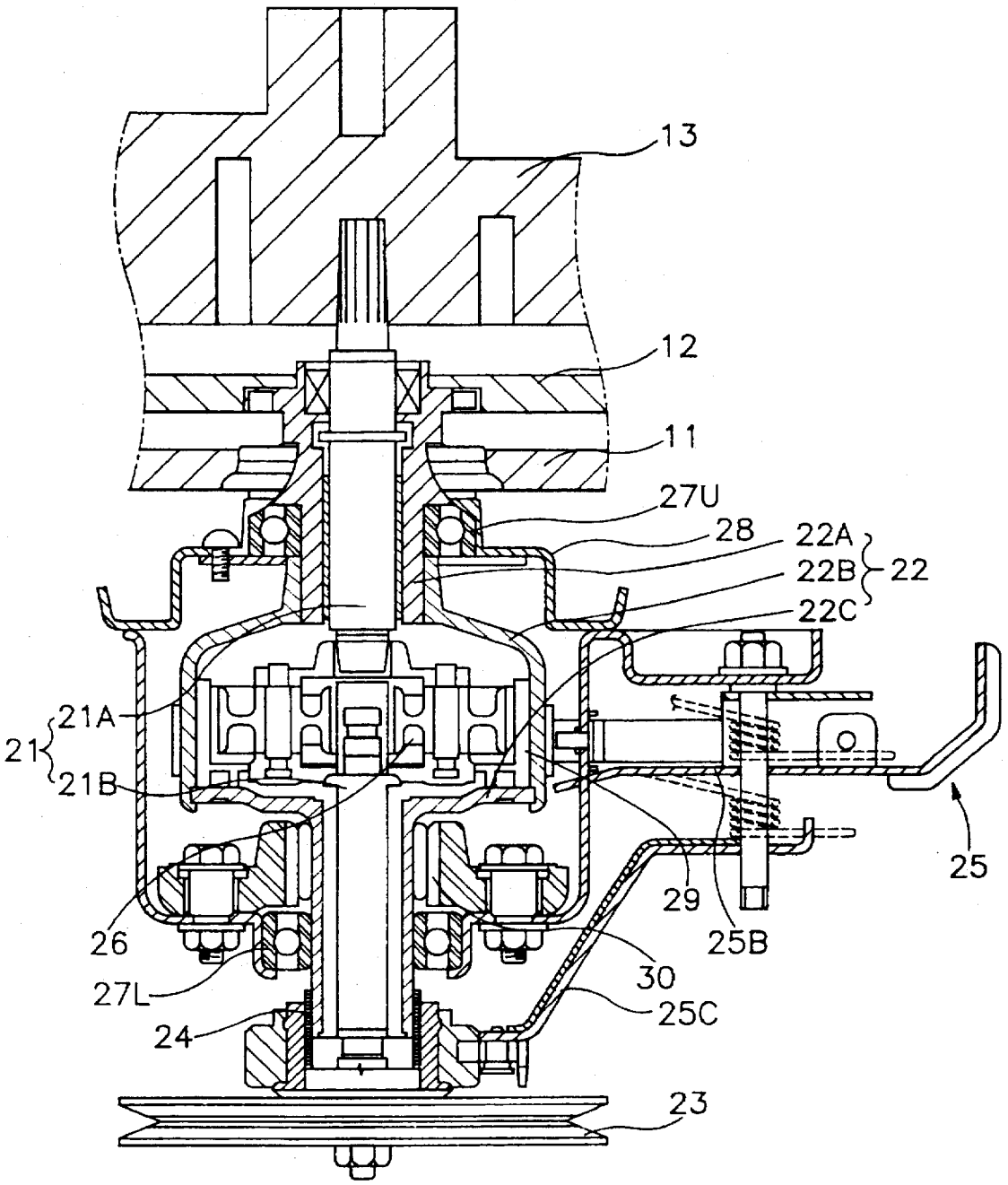
FIG.3 (PRIOR ART)
FIG. 3 is an enlarged vertical sectional view of the conventional power transmission mechanism of and FIG. 2.

FIG.1 illustrates a power transmission mechanism 120 according to the present invention. The same components as the prior art as shown in the conventional mechanism are designated by the same numerals. Thus, a detailed description of those parts will be omitted.

The power transmission mechanism 120 comprises a pulley 23 receiving the rotation force of the motor 15 through the belt 16, a washing shaft assembly 21, a dehydrating shaft assembly 122 and a clutch 24 for coupling/decoupling the dehydrating shaft assembly 122 to the washing shaft assembly 21.

The dehydrating shaft assembly 122 is comprised of a first shaft assembly 122A whose upper end is integrally fitted to the washing basket 12, a third shaft 122C whose lower end is fitted to the lower portion of the second shaft 122B and disengaged by the clutch 24. The upper end of the second shaft 122B which is coupled to the first shaft 122A and the lower end of the second shaft is coupled to the third shaft 122C. The second shaft 122B serves as the gear box of the planetary gear 26 and the drum of the brake 29.

The upper end of the second shaft 122B includes an inner circumference 122P which is fitted on the lower part of the outer circumference 122D of the first shaft 122A, and an outer circumference 122R which is fitted in a bore 127B of an upper bearing 127U fitted into a cup 128.

The assembly stage of the dehydrating shaft assembly 122 is as follows:

First, a metal bearing 121M is fitted on the circumference of the washing shaft assembly 21. That reduces vibration. The first shaft 122A is rotatably fitted on the circumference of the metal bearing 121M.

The outer circumference 122D of the first shaft 122A functions to receive the inner circumference 122P of the second shaft 122B. Next, after assembling the first shaft 122A to the second shaft 122B, the outer circumference 122R of the second shaft 122B is accurately worked or machined so that the second shaft 122B is coaxially arranged relative to the first shaft 122A. Moveover, the upper bearing 127U is press-fitted to the cup 128.

The bore 127B of the upper bearing 127U is mounted on the circumference 122R which is coaxially worked with respect to the washing shaft assembly 21.

Figure 4:
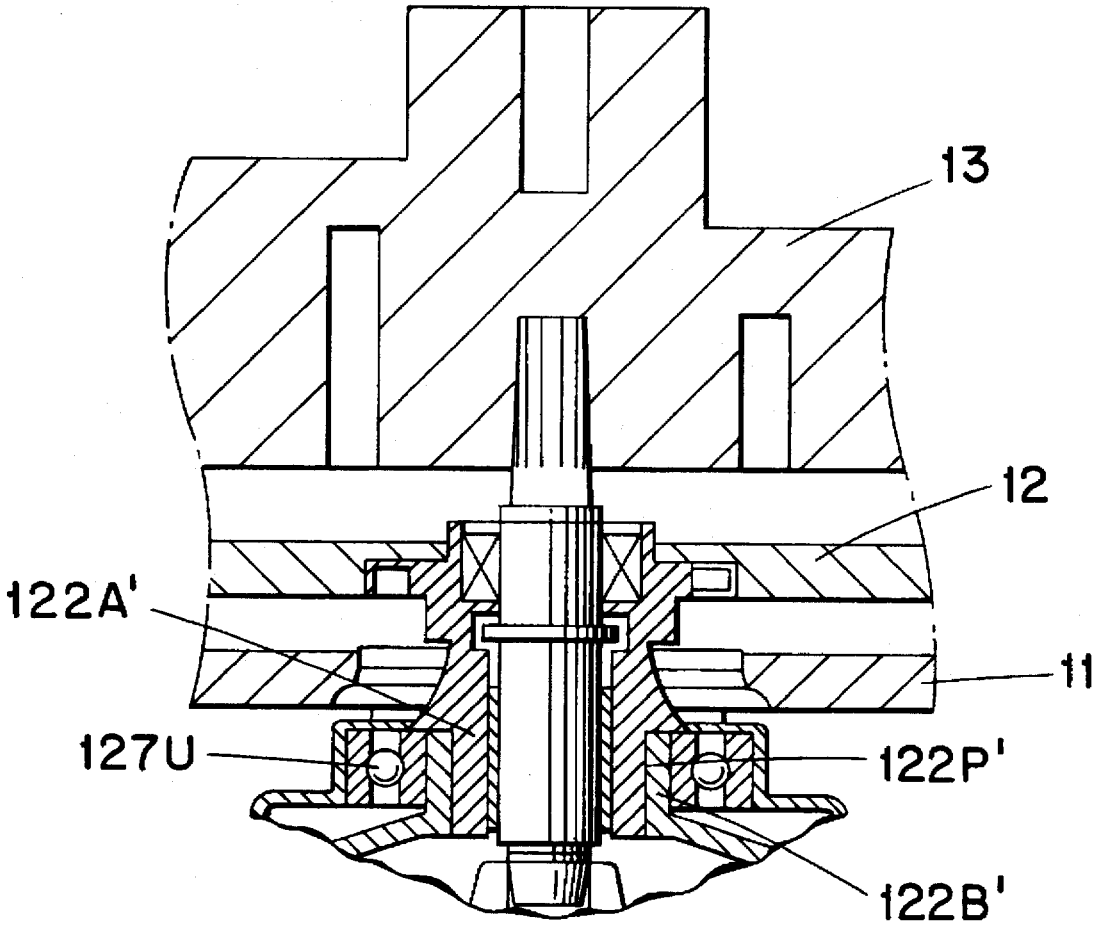
FIG. 4 is a view similar to FIG. 1 of a second embodiment of the invention.

In FIG. 1, the contact region 122P between the second shaft 122B (gear housing) and the first shaft 122A is twice as long as the vertical width of the bearing 27U. FIG. 4 depicts another embodiment wherein a contact region 122P' between the second shaft 122B' (gear housing) and the first shaft 122A' is almost the same as the vertical width of the bearing 127U.

The operation of the a power transmission mechanism is as follows:

In the washing mode, the clutch 24 is released by the lever 25C and the brake 29 is applied to the second shaft 22B by the lever 25B so only the second shaft 21B which is integrally fitted to the pulley 23 is rotated. After the rotation speed of the second shaft 21B is reduced by the planetary gear 26, the reduced speed force of the second shaft 21B is transmitted to the first shaft 21A and thus to the rotating blade 13 which is integrally mounted on the upper end of the first shaft 21A, thereby achieving the washing mode. At this time, the idling rotation of the washing basket 12 is restrained by the cooperation of the one way direction bearing 30 and the brake 29.

In the spinning mode, the clutch 24 is connected by the clutch lever 25 so, the washing shaft assembly 21 is coupled with the spinning shaft assembly 122, and simultaneously the brake 29 is released from the second shaft 122B. The rotation force transmitted to the pulley 23 is transmitted to both washing basket 12 and the rotating blade 13. With the high speed rotation theseof, laundry is dehydrated.

As described above, the power transmission mechanism has a double fitting structure between the upper bearing, the first dehydrating shaft and the second dehydrating shaft. That results in less contact portion than a conventional structure. The concentricity is easily set and the vibration and noise of the power transmission mechanism are decreased, thereby enhancing the reliability of the power transmission mechanism.

Further, since the press-fitting portion requiring the accuracy work is lessened in the area, manufacturing cost of components is saved and the size is decreased.

What is claimed is:

1. A clothes washer, comprising:

a washing basket;

an agitator disposed in the washing basket;

a washing shaft assembly connected to the agitator, the washing shaft assembly including washing shafts interconnected by gearing;

a hollow dehydrating shaft assembly through which the washing shaft assembly extends, the dehydrating shaft assembly including first and second dehydrating shafts, one end of the first dehydrating shaft connected to the basket, another end of the first dehydrating shaft being press fit within one end of the second dehydrating shaft, the second dehydrating shaft forming a housing for the gearing; a motor;

a clutch arranged to selectively connect the motor with the washing and dehydrating shaft assemblies; and a bearing press-fitted to an outer circumference of said one end of the second dehydrating shaft for rotatably supporting the dehydrating shaft assembly.

2. The clothes washer according to claim 1, wherein a contacting portion between said other end of the first dehydrating shaft and said one end of the second dehydrating shaft is almost the same as a vertical width of the bearing.

* * * * *